US005143260A

United States Patent [19]

Loychuk

[11] Patent Number: 5,143,260

[45] Date of Patent: Sep. 1, 1992

[54] AEROSOL ADAPTER CLAMP AND POWER SYSTEM

[75] Inventor: Terrence Loychuk, North Vancouver, Canada

[73] Assignee: Nozone Dispenser Systems, Inc., Vancouver, Canada

[21] Appl. No.: 533,286

[22] Filed: Jun. 5, 1990

[51] Int. Cl.[5] ..... B65D 35/20

[52] U.S. Cl. ..... 222/95; 222/105; 222/386.5

[58] Field of Search ..... 222/95, 105, 107, 131, 222/183, 215, 386.5

[56] References Cited

U.S. PATENT DOCUMENTS

| | | | |
|---|---|---|---|
| 3,940,026 | 2/1976 | Kain | 222/215 |
| 3,961,725 | 6/1976 | Clark . | |
| 3,981,415 | 9/1976 | Fowler et al. | 222/215 |
| 3,993,069 | 11/1976 | Buckles et al. . | |
| 4,087,026 | 5/1978 | Petterson | 222/386.5 |
| 4,121,737 | 10/1978 | Kain . | |
| 4,222,499 | 9/1980 | Lee et al. . | |
| 4,324,350 | 4/1982 | Thompson . | |
| 4,387,833 | 6/1983 | Venus, Jr. | 222/95 |
| 4,446,991 | 5/1984 | Thompson | 222/183 |
| 4,964,540 | 10/1990 | Katz | 222/95 |
| 4,988,018 | 1/1991 | Loychuk | 222/215 |

FOREIGN PATENT DOCUMENTS

| | | | |
|---|---|---|---|
| 178573 | 4/1986 | European Pat. Off. | 222/95 |

*Primary Examiner*—Michael S. Huppert
*Assistant Examiner*—Kenneth Bomberg
*Attorney, Agent, or Firm*—Marger, Johnson McCollom & Stolowitz

[57] ABSTRACT

This invention is directed to a novel adapter clamp and power system which can be used in an aerosol dispensers. More particularly, the novel adapter clamp enables various aerosol spray nozzle systems to be connected to various constructions of aerosol containers utilizing various aerosol power systems. An adapter for enabling a nozzle to be fitted to the top of an aerosol container comprising: (a) a circular ridge formed at the top of the adapter, the ridge being adapted to mate with a rim of an aerosol nozzle; (b) a lip formed around the exterior surface of the adapter at a location below the ridge, the lip being adapted to mate with the periphery edge of the opening in the top of an aerosol container; and (c) an extension at the base of the adapter adapted to extend into the interior of the container, the extension having an opening therein, and being adapted to receive in bearing support the upper region of a first hollow-closed end bladder adapted to power a liquid contained in the aerosol container.

19 Claims, 2 Drawing Sheets

AEROSOL ADAPTER CLAMP AND POWER SYSTEM

FIELD OF THE INVENTION

This invention is directed to a novel adapter clamp and power system which can be used in an aerosol dispenser. More particularly, the novel adapter clamp enables under the cap filling of aerosol containers and various standard aerosol spray nozzle systems to be connected to the aerosol containers. In another aspect, this invention pertains to an aerosol power system which utilizes several concentric rubber-type bladders to generate the expulsion power for the aerosol.

BACKGROUND OF THE INVENTION

The use of bladders as gas and liquid contents containers and propellants in aerosols is becoming more common, particularly since commonly used fluorochloro-carbon and other volatile propellants have been shown to be harmful to the environment, including causing damage to the ozone layer of the earth. Such bladders are commonly filled by an awkward process utilising special valves supplied by the bladder manufacturers. A need has existed for some time for a bladder mechanism which can be used by all aerosol manufacturers with existing standard equipment and which can be used on any bladder and any aerosol can. Such a mechanism should be sufficiently versatile that it can be used in the aerosol container production line for either "under the cap" filling or for "through the valve" filling.

Until recently, aerosols during manufacture were pressurised by injecting the propellant through the valve nozzle mounted at the top of the aerosol. This is a slow and inefficient process. Latterly, a more efficient "under the cap" process has been developed for rapidly filling aerosols on an assembly line with both working fluid and propellant in a pressurised environment. On the production line, the cap and nozzle of the aerosol are temporarily lifted under a pressurized filler head which fits on the top of the container and the contents and propellant are injected directly into the container, rather than through the valve. Unfortunately, this more modern efficient filling procedure has not been available for filling bladder powered aerosols. Such aerosols continue to be inefficiently filled "through the valve".

In recent years, there has been alarming evidence that the protective ozone layer of the earth is shrinking in thickness. The ozone layer is critical to the health of living organisms inhabiting the earth because the ozone layer filters out deadly ultra-violet rays, and other rays, emitted by the sun. Considerable evidence has been gathered to demonstrate that the damage that is occurring to the ozone layer is caused by a number of mankind generated free radicals and flurochlorocarbon-type propellants which have been used in aerosol container spray systems for many years. These propellants are lighter than the lower atmosphere and ascend to the elevation of the ozone layer. Chemical reactions then take place between the radicals and the ozone in the ozone layer thereby forming other compounds and complexes. This diminishes the free ozone in the ozone layer. There has been recent evidence to indicate that deadly holes have appeared in certain portions of the ozone layer, for example, over Antarctica. If this trend continues, the health of all living beings on the earth will be jeopardized.

Recently, industrialized nations of the world have agreed to an international moratorium on the use of substances which have been demonstrated to have a destructive effect on the ozone layer of the earth. In 1987, the United States enacted sunset-type legislation which forces companies that are manufacturing substances which are demonstrated to have a destructive effect on the ozone layer to phase out production of such harmful substances over a specified number of years. One of the most ozone layer destructive family of substances being manufactured are fluorochlorocarbons (Freons), which are widely used as coolants in refrigeration systems, and as propellants in aerosol spray containers holding products such as hair spray, cleaning compounds, and the like.

Because of the mounting evidence that fluorochlorocarbon propellants, and similar type volatile propellants, in aerosol contained spray systems, have a cumulative damaging effect on the ozone layer, it is critical to the long term health of living beings on the earth to develop alternative aerosol generating containers which do not rely upon ozone destroying propellants. As an alternative, many aerosol-type consumer products recently introduced on the market utilize a manual pump-type aerosol spray generating system. However, such manually operated aerosol pump systems are not entirely satisfactory because they are incapable of generating a fine consistent spray similar to the type that is generated by an aerosol container employing a fluorochlorocarbon propellant.

A number of patents have been granted in recent years for aerosol generating pump systems, and the like. These are useful as alternatives to volatile propellant aerosol generating sytems. U.S. Pat. No. 3,993,069, granted Nov. 23, 1976, Buckles et al., for example, illustrates a pumping system which utilizes a natural rubber bladder which is inflated. This inflated bladder generates pumping action from the force that is created by the bladder seeking to return to its original size and shape.

U.S. Pat. No. 4,222,499, granted Sep. 16, 1980, Harold D. Lee et al., discloses an apparatus for pressurized dispensing of fluid products comprising an elastomeric pressure unit, a support, a sealing member, and a valve. The apparatus may additionally include either a container for a housing around the pressure unit or a liner within the pressure unit. The elastomeric pressure unit has an internal cavity which contains the fluid product and provides the dispensing pressure. An assembly of such an apparatus is obtained without bonded connection and without the requirement of an additional sealing member when a liner is used. Lee et al employ a through the valve filling technique.

U.S. Pat. No. 4,324,350, granted Apr. 13, 1982, Kenneth W. Thompson, discloses a unitary, self-contained fluid spray dispenser comprising an elongated tubular expandable unit of elastomeric material of selected diameter and length. It is attached at its open end by a bonding agent to a valve support plate by way of a plastic neck piece carried by the open end of the unit. The expandable unit is filled with fluid to be dispensed through the valve and is distended to a selected volume and internal pressure. A housing of various materials can be implemented to carry the dispenser for purposes of convenience, handling and appearance.

U.S Pat. No. 4,121,737, granted Oct. 24, 1978, Calvin L. Kain, discloses an apparatus for pressure dispensing fluid products. The apparatus has an elastomeric pressure unit disposed in surrounding relationship to a flexible, fluid-tight liner. The liner has its open end sealably engaged with a valve support and a dispensing valve therein. The inherent elastomeric contracting force provides the dispensing pressure for the product contained within the flexible liner. The liner prevents contact between the product and the elastomeric material of the pressure unit.

U.S. Pat. No. 3,961,725, granted June, 1976, Clark, discloses an aerosol power system utilizing a bladder with a liner. The liner is indicated to be of a non-elastomeric material. There is no disclosure in this patent of using the liner and the outer bladder in combination as a power system.

None of the aforementioned patents disclose the concept of two or more concentrically arranged bladders which contribute a cumulative propulsion force in expelling contents from the container through the nozzle. Also none of the noted patents show a clamp which can be used in an aerosol container to permit under the cap filling and which enables two or more bladders to be secured to the nozzle and valve assembly of the aerosol container.

SUMMARY OF THE INVENTION

A circular hollow adapter suitable for enabling an aerosol nozzle to be fitted to the top opening of an aerosol container comprising a circular ridge formed at the top of the adapter the ridge being adapted to mate with a rim of an aerosol nozzle with a lip formed around the exterior surface of the adapter at a location below the ridge, and above the base of the adapter, the lip being adapted to mate with the peripheral edge of the top opening of an aerosol container, and an extension at the base of the adapter adapted to extend into the interior of the container, the extension having an opening therein, and being adapted to receive in bearing support the upper region of a first hollow—closed-end bladder adapted to power a liquid contained in the aerosol container. The adapter is of a general hollow cylindrical shape where the ridge has a rounded profile. The interior of the adapter is circular and has a lip thereon which is adapted to receive the free end of a second hollow—closed-end bladder, positioned inside the first bladder. A groove is formed in the interior circumference in association with the interior lip of the interior of the adapter to receive a rimmed flange formed at the top of the second bladder.

A shoulder is formed in the circular exterior surface of the mid region of the adapter, above the lip and below the ridge, to conform with a sealing ring of an aerosol container filling machine. The interior of the adapter is adapted to receive a third hollow—closed-end bladder, which is positioned inside the second bladder. The interior surface of the adapter has a raised rim which is adapted to mate with a rim formed on a flange at the top of the third bladder. The extension at the base of the adapter is in the form of a tube.

A power system for an aerosol spray generating nozzle at the top of an aerosol container comprising an adapter formed to enable an aerosol nozzle to be secured to the top of an aerosol container, a first hollow open-ended resilient means connected by its open end to the adapter, and a second hollow open-ended resilient means positioned inside the first hollow resilient means, and being secured by its open-end directly or indirectly to the adapter, the second resilient means being adapted to contain the aerosol contents used to generate the aerosol spray, the first and second resilient means cooperating to generate a cumulative pressure on the contents when the first and second resilient means are expanded by being filled with the contents. The second resilient means may have positioned inside thereof a third hollow open-ended resilient means which is secured by its open end directly or indirectly to the adapter, the third resilient means cooperating with the first and second resilient means to generate a cumulative pressure on the contents when the three resilient means are expanded by contents.

The first, second, and third resilient means can be formed of natural rubber. The third resilient means can be formed of a material selected from the group consisting of food grade silicone rubber, nitrile, natural latex, butyl and Neoprene. The first resilient means is capable of expanding within a range of about 300 to 500 percent. The second resilient means is capable of expanding within a range of about 500 to 700 percent. The third resilient means is capable of expanding within a range of about 700 to 900 percent. The second and third resilient means are constructed in the form of elongated tubes which are closed at one end, are open at the other end, fit one inside the other, and each has a flange around the open end. The first resilient means is constructed in the form of an elongated tube which is open at both ends, the first resilient means being adapted to fit outside the second resilient means.

DRAWINGS

In drawings which illustrate various embodiments of the invention, but which should not be regarded as restricting the spirit or scope of the invention in any way:

FIG. 1 illustrates a section view of a bladder-to-can adapter which is amenable to under the cap filling techniques and can enable three power bladders to be connected to the aerosol nozzle, valve and container assembly;

FIG. 2 illustrates a front section view of the bladder-to-can adapter affixed to the top of an aerosol can, with three concentric uninflated bladders affixed to the bladder-to-can adapter, capped for through the valve filling; and FIG. 3 illustrates a front section view of the bladder-to-can adapter affixed to the top of an aerosol can, adapted for under the cap filling, with the three concentric bladders expanded to receive the contents of the aerosol that are to be discharged from the aerosol can.

DETAILED DESCRIPTION OF A SPECIFIC EMBODIMENT OF THE INVENTION

The adapter clamp of this invention is neatly compatible with a conventional aerosol container can and a conventional aerosol nozzle assembly. It can be used with a variety of types of bladder aerosol power systems coupled with conventional aerosol cans. The adapter clamp has a basic form which can be used with existing aerosol cans, thereby permitting aerosol manufacturers to use conventional filling equipment and current stocks of aerosol cans. The adapter can be built into new aerosol cans during manufacture. The adapter clamp of the invention enables conventional under the cap aerosol filling equipment to be used for filling bladder powered aerosol cans without adaptation. It enables the filling of the aerosol can to be performed in one step as is now utilised for filling conventional gas propellant aerosol systems. The adapter clamp is designed to be used in association with two or more outer rubber bladders and a protective inner liner, the combination cooperating as an aerosol propellant system.

Figure 1:
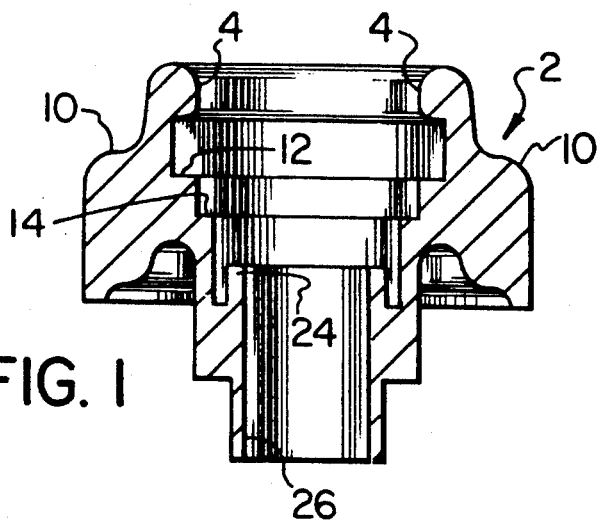
Figure 2:
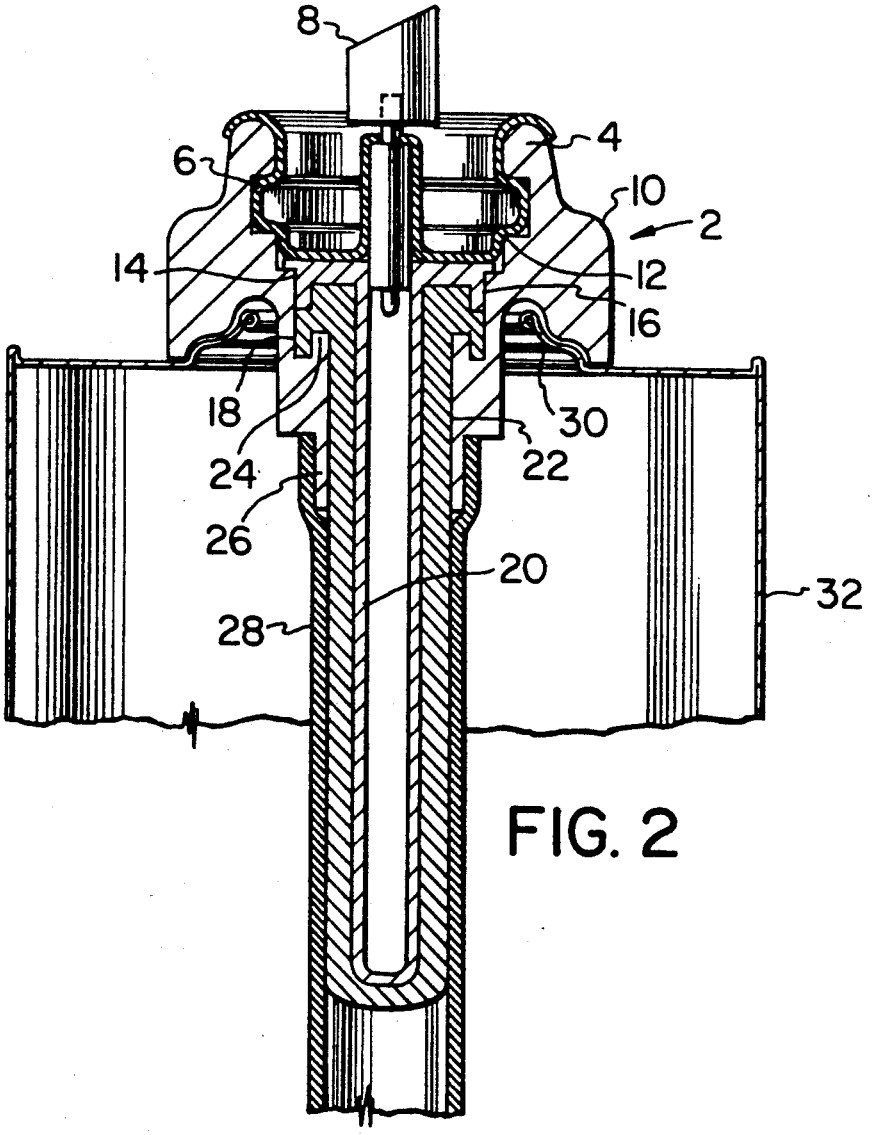

Referring to FIG. 1, which illustrates a front elevation section view of the bladder-to-can adapter, it can be seen that the adapter 2 generally has a top portion 3 and a base portion 5. The adapter 2 has a relatively complex profile to enable it to accomodate three power bladders, the valve nozzle assembly, and the top 42 of the aerosol can. The manner in which the base sealing lip 30 of the adapter 2 mates with the dome 40 of a standard aerosol container is illustrated in FIG. 2. The top rounded rim 4 is formed to receive the sealing rim 7 of the protective sealing cup of a standard aerosol container with a top nozzle (see cup 6 and nozzle 8 in FIG. 2). The cup 6 is stamped in place in the top interior region of the adapter 2.

The adapter 2 is of a hollow circular configuration (when seen from above or below) and has an exterior rounded tapered shoulder 10 on the exterior of the adapter below the rounded rim 4. The tapered shoulder 10 is machined to conform with the sealing ring of an "under the cap" filling head of a standard aerosol filling machine (see FIG. 3). In the past decade or so, aerosol can filling machines have been designed or converted so that the aerosol container can be quickly filled "under the cap", rather than slowly through the valve. With the "under the cap" technique, the cap is temporarily lifted from the container as it proceeds along the aerosol can filling line. The bladder is then filled with the contents of the aerosol. Subsequently, the cap is lowered onto the top of the adapter. Lastly, the cap is stamped in place on the adapter of the filled aerosol can.

The lower interior region of the adapter 2 is formed with tiered concentric sharp shoulders 12 and 14. A raised power tube sealing lip 24 having a diameter that is less than the diameter of shoulder 14 is located below shoulders 12 and 14. Tube sealing lip 24, cooperatively with base portion 5, defines power tube sealing groove 25. A tube 26 of diameter similar to lip 24 is formed at the bottom of the adapter 2.

As seen in FIG. 2, which illustrates a front section view of the bladder-to-can adapter affixed to the top of the aerosol container, with three concentric bladders below, adapted for through the valve filling, it can be seen that shoulder 12 receives the bottom of the nozzle cup 6 which carries the nozzle 8. Sleeve 15 is formed in adapter 2 below shoulder 14 to receive the flanges 16 and 18 of concentric liner and middle aerosol power tubes 20 and 22 respectively. The respective flanges 16 and 18 are held firmly in place by lip 24 to provide a tight seal. The base sealing lip 30 of shoulder 10 is formed to conform with the profile of the dome top of aerosol can 32.

Extension tube 26, formed at the base of adapter 2 is formed to accommodate the interior surface of a third power tube 28. Tube 26 prevents the third power tube 28 from detaching from adapter 2 when the two interior liner and middle power tubes 20 and 22 respectively are inflated with aerosol contents (see FIG. 3).

Figure 3:
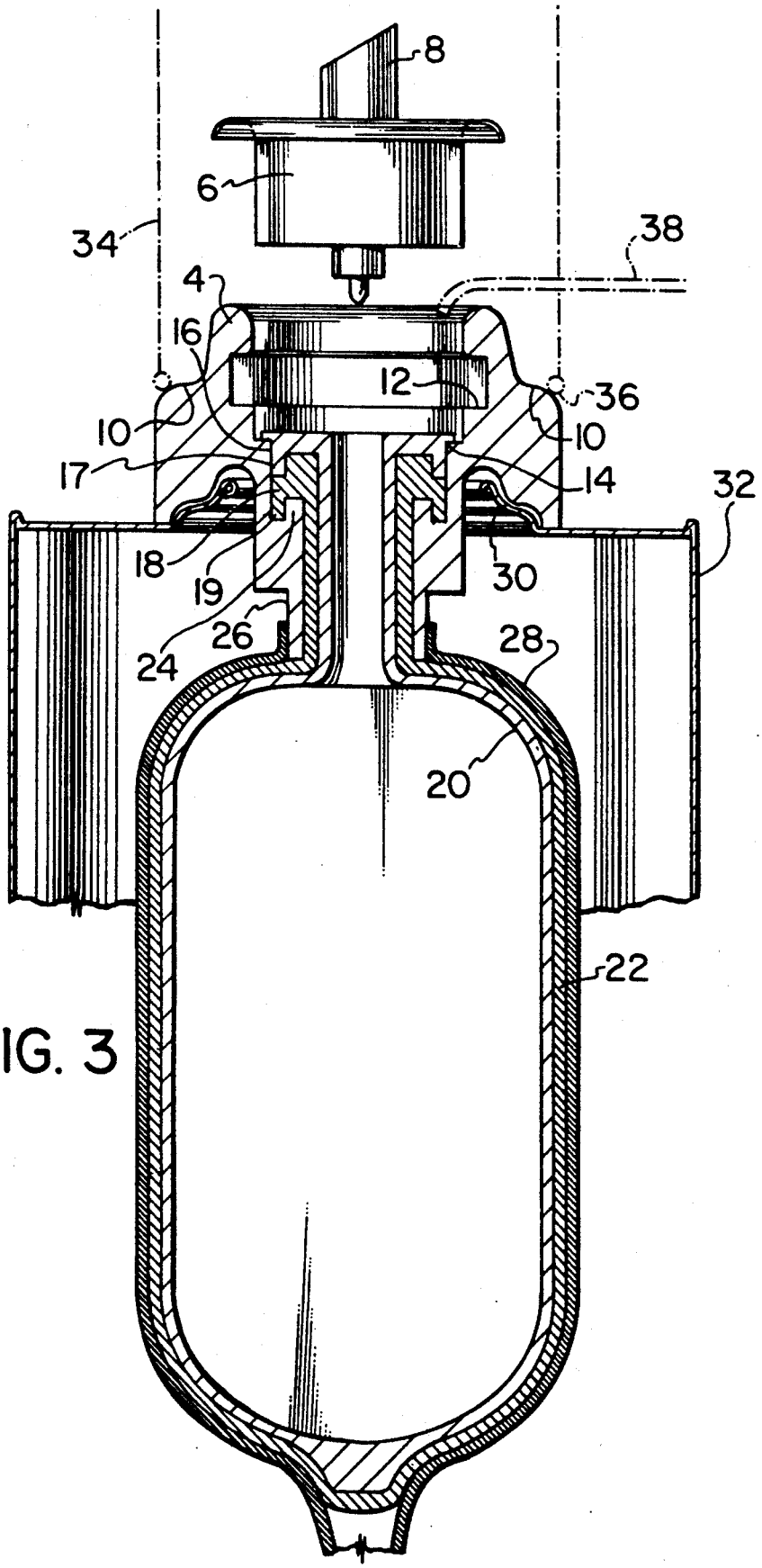

FIG. 3 illustrates a front section view of the bladder-to-can adapter with the three concentric power bladders expanded to receive the contents of the aerosol container. FIG. 3 illustrates "under the cap" filling. The triple power tube system comprising liner tube 20, middle tube 22 and outer tube 28 are fully extended with the ingredients that are to be held in liner tube 20. As can be seen in FIG. 3 the third power tube 28, when extended, slips down the tube 26 somewhat, due to the inflation action of inner power liner tube 20 and intermediate power tube 22, but it does not disengage from tube 26. No bonding agent between tube 26 and the third power bladder 28 is required.

FIG. 3 illustrates in detail the construction of the flange 16 which has a downwardly extending circular rim 17, which provides a seal to prevent product entering between tube 20 and tube 22. Likewise, flange 18 of power tube 22 has a downwardly extending circular rim 19 which prevents product entering between tube 22 and lip 24.

The triple power tube system provides increased power to discharge the contents of the interior liner tube 20 through valve 8, as an aerosol, when the cap 6 is stamped in place on top of adapter 2. The power generated is approximately the sum of the elastic forces of the expanded three power tubes 20, 22 and 28. Normally, the three power tubes provide sufficient power to ensure that the contents held in liner tube 20 are expelled through the nozzle 8 as a fine spray. However, if required, a fourth power tube can be added, with appropriate modification in the adapter 2. Such modification could include extending the length between shoulder 14 and lip 24. Further tubes can be added in similar manner to achieve higher power levels.

FIG. 3 illustrates "under the cap" filling of the liner 20 of the power tube dispenser system. A filler head under cap 34 is lowered onto shoulder 10 to provide a tight seal at the lower rim 36. Product is pumped under pressure into the sealed chamber by port 38, and enters liner tube 20, which along with tubes 22 and 28, expand to accommodate the product. After filling, cap 6 and nozzle 8 are stamped in place on adapter head 4. Cap 34 is then removed.

A secure pressure seal is created by the application of pressure on the large upper surface area of flanges 16 and 18 on lip 24. This arrangement performs efficiently over a wide range of presures with the rubber or elastomer tubes of most existing bladder dispensers in combination with the adapter. The adapter performs properly over a wide range of pressures. It seals instantly when pressure is applied to the container and does not allow the escape of any product in the process. If required, the adapter also allows for "through the valve" filling if the dispenser is crimped before filling, as illustrated in FIG. 2.

The adapter is unique in that it permits all bladder type aerosol dispensers to be filled with conventional "under the lid" equipment, slightly modified for pumping liquid product. This allows the use of standard, cost effective existing aerosol cans and valves to be used. Because the adapter is universal for different valves, cans and bladders, production flexibility and immediate construction of custom containers are easily available to manufacturers to accommodate efficiently marketing and sales requirements. The adapter also offers the advantage of being readily visible to the end user and thereby acts as a flag of environmental differentiation from propellant aerosols.

Three performance tests have been conducted on triple and quadruple bladder power systems, the bladders being constructed of various resilient materials. The tests are summarized in TABLE I.

TABLE I

| Description of Test Components and Test Number | Delivery (Static) Pressure | Volume | Tube Length |
|---|---|---|---|
| Test 1: | | | |
| Nitrile B. Inner Liner Tube | 12 psi | 100 ml | 75 mm |
| Natural Rubber Power Tube | 32 psi | | |
| Natural Rubber Auxiliary Power Tube | 20 psi | | |
| Total Assembled 3 Ply Laminate | 60 psi | | |
| Test 2: | | | |
| Natural Rubber Inner Liner | 18 psi | 100 ml | 75 mm |
| Natural Rubber Power Tube | 31 psi | | |
| Natural Rubber Auxiliary Power Tube | 20 psi | | |
| Total Assembled 3 Ply Laminate | 69 psi | | |
| Test 3: | | | |
| Nitrile Inner Liner | 17 psi | 100 ml | 75 mm |
| Natural Rubber Power Tube | 32 psi | | |
| Natural Rubber Auxiliary Tube 1 | 20 psi | | |
| Butyl Rubber Auxiliary Tube 2 | 9 psi | | |
| Total Assembled 4 Ply Laminate | 72 psi | | |

DISCUSSION

Pressure readings were taken after a 30 min. period. It was noted that natural rubber had better memory properties than either the synthetic nitrile or butyl rubber compounds. This fact accounts for the totals in Tests 1 and 3 not totalling 100 percent. In Test 2, however, the total of all natural rubber components was observed as 100 percent. The total assembled 3 ply laminate in Test 1 and the total assembled 4 ply laminate in Test 3 were about 6 to 8% less than the sum of the individual components.

It was noted that when the tubes were elongated under pressure, the inner liner elongated within a range of about 700 to 900 percent, the power tube elongated within a range of about 500 to 700 percent, the auxiliary power tube elongated within a range of about 300 to 500 percent, and the second auxiliary tube elongated within a range of about 200 to 300 percent.

EXAMPLE 1

Assembly and Test Filling of Prototype Dispenser System

A "STANDARD" aerosol can was used for this test. A steel adapter according to the invention was placed over a rubber tube and the flanged washer end of the rubber tube was tucked into the steel adapter. Sealant was placed on the top rim of the empty can. The steel adapter with the tube was pushed into the can and the adapter was pressed firmly onto the can rim thereby making a good seal for "under the lid" sealing. The valve assembly was then placed loosely on the top of the can and adapter.

The unit was then passed through standard blockhouse aerosol filling equipment (ie. for filling and sealing). Instead of filling with propellant and gas, however, the can was filled with a liquid product blended for direct use. The large flat surface of the rubber washer flange on the rubber tube was found to be satisfactory in that the seal was 100% when subjected to the pressure associated with filling the can with liquid product.

Filling speeds and pressures were kept as low as possible initially and product temperatures were held close to room temperature initially. It was apparent that higher speeds and pressures would be possible. The adapter rims, once the can was filled, were crimped and sealed. No leaks were apparent. It was therefore evidence that the adapter design according to the invention performed effectively.

As will be apparent to persons skilled in the art, various modifications and adaptations of the structure above-described are possible without departure from the spirit of the invention, the scope of which is defined in the appended claims.

I claim:

1. A circular hollow adapter with a top and base portion, the top for receiving an aerosol nozzle and cup, and the base for being fitted to an opening at the top of an aerosol container comprising:

(a) a circular rounded rim formed at the top of the adapter, said rounded rim being adapted to mate with a sealing rim of an aerosol nozzle and cup:

(b) a base sealing lip formed in the base portion of the adapter at a location below the rounded rim, said base sealing lip being adapted to mate with a peripheral edge of the aerosol container top opening;

(c) a shoulder formed around the interior surface of the hollow adapter at a location below the rounded rim and above the base of the adapter, the shoulder being adapted to receive an open end of a hollow, non-pleated resilient first internal power tube;

(d) a sleeve formed around the interior surface of the adapter of a diameter smaller than the diameter of the shoulder (c), the sleeve being at a location below the shoulder (c) and coextensive with the base of the adapter, the sleeve being adapted to engage an outer surface of an open end of a hollow resilient second power tube;

(e) a hollow non-pleated resilient first interior power tube closed at one end and open at the opposite end, having a consistent thickness throughout most of its length, the open end fitted to the shoulder; and (f) a hollow resilient second power tube closed at one end and open at the opposite end having a consistent thickness throughout most of its length, fitting on the outside of the inner resilient first power tube (e), the open end outer surface sealingly engaging the sleeve (d).

2. An adapter as claimed in claim 1 wherein the interior of the adapter is circular and wherein the sleeve has a raised power tube sealing lip extending vertically upward therefrom for sealingly engaging the free end of the hollow resilient second power tube bladder, and which is positioned below the shoulder.

3. An adapter as claimed in claim 2 wherein a power tube sealing groove is formed between the raised power tube sealing lip and the base portion, the power tube sealing groove being adapted to receive a rimmed flange formed at the open end of the second power tube (f).

4. An adapter as claimed in claim 2 wherein a shoulder is formed in a circular exterior surface of the adapter, sealingly engage a sealing ring of an under the cap aerosol container filling machine.

5. An adapter as claimed in claim 3 wherein the shoulder (c) of the interior of the adapter is adapted to receive a rimmed flange formed at the open end of the first resilient interior power tube.

6. An adapter as claimed in claim 1 wherein the adapter includes a circular extension at the base of the adapter adapted to extend into the interior of the container, said extension having an opening therein, and being adapted to receive in bearing support the upper region of a hollow third resilient power tube.

7. An apparatus as defined in claim 6 including a hollow resilient third power tube open at both ends, having a consistent thickness along most of its length, fitting on the outside of the second hollow resilient power tube, fitted to the circular extension.

8. An apparatus as defined in claim 7 wherein the third power tube is longer than the first and second power tubes.

9. An adapter as claimed in claim 6 wherein the extension at the base of the adapter is in the form of a tube.

10. An apparatus for generating an aerosol spray comprising:

an aerosol container having an opening at the top;

an aerosol nozzle and cup;

a circular hollow adapted with a top and base portion, the top for receiving the aerosol nozzle and cup, and the base for being fitted to the opening at the top of the aerosol container, the adapter including:

(a) a circular rounded rim formed at the top of the adapter, said rounded rim being adapted to mate with a sealing rim of the aerosol nozzle and cup;

(b) a base sealing lip formed in the base portion of the adapter at a location below the rounded rim, said base sealing lip being adapted to mate with a peripheral edge of the aerosol container top opening;

(c) a shoulder formed around the interior surface of the hollow adapter at a location below the rounded rim and above the base of the adapter, the shoulder being adapted to receive an open end of a hollow, non-pleated resilient first internal power tube;

(d) a sleeve formed around the interior surface of the adapter of a diameter smaller than the diameter of the shoulder (c), the sleeve being at a location below the shoulder (c) and coextensive with the base of the adapter, the sleeve being adapted to engage an outer surface of an open end of a hollow resilient second power tube;

(e) a hollow non-pleated resilient first interior power tube closed at one end and open at the opposite end, having a consistent thickness throughout most of its length, the open end fitted to the shoulder (c); and (f) a hollow resilient second power tube closed at one end and open at the opposite end having a consistent thickness throughout most of its length, fitting on the outside of the inner resilient first power tube (e), the open end outer surface sealingly engaging the sleeve (d);

the aerosol nozzle and cup being sealingly engaged with the adapter top portion; and the adapter base portion being sealingly engaged with the aerosol container top opening.

11. An apparatus as defined in claim 10 wherein the second hollow resilient power tube has positioned outside thereof a third hollow open-ended resilient means which is secured by its open end to the adapter, the third resilient means cooperating with the first and second hollow resilient power tubes to generate a cumulative pressure on the contents when the three resilient means are expanded by the aerosol contents.

12. An apparatus as defined in claim 10 wherein the first and second hollow resilient power tubes are formed of natural rubber.

13. An apparatus as defined in claim 11 wherein the third resilient mean is formed of natural rubber.

14. An apparatus as defined in claim 11 wherein the third resilient means is formed of a material selected from the group consisting of food grade silicone rubber, nitrile, natural latex, butyl and Neoprene.

15. An apparatus as defined in claim 13 wherein the first hollow resilient power tube is capable of expanding within a range of about 300 to 500 percent.

16. An apparatus as defined in claim 13 wherein the second hollow resilient power tubes is capable of expanding within a range of at least about 500 to 700 percent.

17. An apparatus as defined in claim 13 wherein the third resilient means is capable of expending within a range of about 700 to 900 percent.

18. An apparatus as defined in claim 11 wherein the first and second hollow resilient power tubes are constructed in the form of elongated tubes, and each has a flange around the open end.

19. An apparatus as defined in claim 11 wherein the third resilient means is constructed in the form of an elongated tube which is open at both ends the third resilient means being adapted to fit outside the second hollow resilient power tubes.

* * * * *